US011596819B2

(12) United States Patent
Anicet

(10) Patent No.: US 11,596,819 B2
(45) Date of Patent: Mar. 7, 2023

(54) FIRE SUPPRESSION SYSTEM FOR A STRUCTURE OR A VEHICLE

(71) Applicant: Jean Anicet, Elmont, NY (US)

(72) Inventor: Jean Anicet, Elmont, NY (US)

( * ) Notice: Subject to any disclaimer, the term of this patent is extended or adjusted under 35 U.S.C. 154(b) by 20 days.

(21) Appl. No.: 16/861,316

(22) Filed: Apr. 29, 2020

(65) Prior Publication Data

US 2020/0346056 A1 Nov. 5, 2020

Related U.S. Application Data

(60) Provisional application No. 62/841,216, filed on Apr. 30, 2019.

(51) Int. Cl.

| | |
|---|---|
| ***A62C 3/07*** | (2006.01) |
| ***A62C 37/38*** | (2006.01) |
| ***A62C 37/48*** | (2006.01) |
| *G08B 17/103* | (2006.01) |
| *A62C 35/02* | (2006.01) |
| *G08B 17/11* | (2006.01) |

(52) U.S. Cl.

CPC ..... *A62C 3/07* (2013.01); *A62C 37/38* (2013.01); *A62C 37/48* (2013.01); *A62C 35/02* (2013.01); *G08B 17/103* (2013.01); *G08B 17/11* (2013.01)

(58) Field of Classification Search

CPC ..... A62C 3/07; A62C 35/02; A62C 37/38; A62C 37/40; A62C 37/48; G08B 17/103; G08B 17/11

See application file for complete search history.

(56) References Cited

U.S. PATENT DOCUMENTS

| | | | | |
|---|---|---|---|---|
| 5,808,541 | A * | 9/1998 | Golden | A62C 37/40 169/26 |
| 6,981,555 | B2 * | 1/2006 | Smith | A62C 3/07 169/56 |
| 8,307,934 | B2 * | 11/2012 | Rini | B60L 3/04 180/271 |
| 2004/0226726 | A1 * | 11/2004 | Holland | A62C 13/22 169/62 |
| 2008/0017393 | A1 * | 1/2008 | Whitney | A62C 37/11 169/60 |
| 2011/0155397 | A1 * | 6/2011 | Icove | G08B 17/12 169/16 |
| 2017/0088272 | A1 * | 3/2017 | Meis | A62C 2/00 |
| 2018/0099170 | A1 * | 4/2018 | Baldino | B05B 1/02 |

* cited by examiner

*Primary Examiner* — Tuongminh N Pham

(74) *Attorney, Agent, or Firm* — Brennan, Manna & Diamond, LLC

(57) ABSTRACT

An automatic fire suppression system for use in extinguishing residential fires or engine compartment fires in a vehicle. The automatic fire suppression system in mountable on a ceiling or under a hood of the vehicle or above the vehicle's engine if located elsewhere. The automatic fire suppression system retains an extinguishing agent in an extinguishing agent reservoir. A detection component for detecting heat or smoke triggers the release of the extinguishing agent according to a preset heat level or smoke condition. Once released, the extinguishing agent is dispensed onto the fire by through a plurality of orifices in a distribution component to effectively suppress the fire.

3 Claims, 5 Drawing Sheets

FIRE SUPPRESSION SYSTEM FOR A STRUCTURE OR A VEHICLE

CROSS-REFERENCE

This application claims priority from Provisional Patent Application Ser. No. 62/841,216 filed on Apr. 30, 2019.

BACKGROUND

House fires are more common than many people think. In the United States alone, there are approximately 350,000 residential house fires every year. There are over 2600 deaths, 12,000 injuries, and property damage in the range of $7 billion every year on average. Residential house fires typically start from open flames, such as candles, accidents, and cooking, among other causes. Residential smoke detectors are credited with saving the most lives as fires often occur when no one is present at the location of the fire. By the time the residents are alerted, it may be too late to attempt to safely put out the fire with an extinguisher.

Commercial and high life hazard locations, such as schools, hotels, and nursing homes are required by the fire code to have even greater protection than only smoke detectors as the danger is even greater. These locations have automatic sprinkler systems installed to automatically dispense water in the event of a fire. However, they are not often practical for residential applications despite the clear benefits. When residential sprinklers are present, the civilian death rate is approximately 80 percent lower and the fire is contained to the room of origin 97 percent of the time. Unfortunately, retrofitting residential structures with this protection is usually cost prohibitive, and even adding it to new construction significantly increases the price.

Automobile accidents, both minor and major, have a chance to leave drivers and passengers with serious injuries. In 2018 alone, there were over 180,000 highway vehicle fires reported in the in the United States alone costing millions of dollars. In some accidents, the engine can be affected and catch on fire. Every year, vehicle fires kill more than 300 people and injure at least 1,250 more. While some car fires are caused by collisions, they are more often caused by problems with the vehicles electric wiring or fuel systems leaving the engine to catch on fire. These dangers are often overlooked.

Toxic gases and other hazardous substances, along with explosions and flying debris, combine to produce serious dangers to drivers, occupants, and bystanders alike. Automobiles, trucks, and other motor vehicles are manufactured from many synthetic materials that emit these harmful, toxic, and deadly gases when they burn. Some of the main byproducts of fire gases are lethal concentrations of carbon monoxide and hydrogen cyanide gases. These gases are odorless, colorless, and tasteless making them difficult to detect, yet no less deadly.

Additionally, these fires can cause fatal or painfully debilitating burn injuries. A typical vehicle fire can generate heat upward of 1,500 degrees Fahrenheit. Flames from burning vehicles can often shoot out ten feet or more away from the vehicle. Vehicle fires are so dangerous that firefighters wear full protective fire-resistant clothing and equipment, as well as self-contained breathing apparatus to keep themselves safe during fire suppression operations. Unlike the general public, firefighters also have the ability to quickly put out vehicle fires with large quantities of water or other extinguishing agents. Drivers have no such protective equipment and may have only a small fire extinguisher at best.

When a fire in a house or the engine compartment of the vehicle occurs, there is often little time to react. The fire may not be able to be put out quickly leaving the occupants in even more danger. Some occupants may be unaware of troubles and a fire could occur without their knowledge initially. If the fire occurs while the vehicle is in motion, the driver may not have enough time to pull out of traffic to a safe location and could even hit other vehicles. In the event of an accident, the occupants could be trapped in the vehicle or in shock preventing them from effectively escaping or putting out the fire. Additionally, vehicle damage could make access to the engine compartment impossible.

Accordingly, there is a great need for a uniquely designed fire extinguishing system for a structure or a vehicle. The fire extinguishing system of the present invention is capable of immediately detecting and extinguishing fire or pre-fire smoke condition before the fire takes over the structure or the entire vehicle. Advantageously, the present invention functions as a tool to save lives and property before emergency response personnel can reach a structure or the vehicle in an emergency situation. Additionally, the present invention makes it easy to retrofit existing structures with automatic fire suppression capabilities with the advantages of a sprinkler system in an economical fashion.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an automatic fire suppression system. The automatic fire suppression system may be placed in an indoor location, such as a ceiling in a room in a residential structure. Alternatively, the automatic fire suppression system is mountable under the hood of a vehicle or above the vehicle's engine if located elsewhere. The automatic fire suppression system comprises an extinguishing agent reservoir. The extinguishing agent reservoir is retained in a housing and is configured to retain at least one extinguishing agent.

The at least one extinguishing agent may be a single extinguishing agent or a mixture of extinguishing agents. The at least one extinguishing agent is effective to suppress ordinary solid combustibles, flammable liquids and energized electrical equipment. The extinguishing agent reservoir may be configured to retain the at least one extinguishing agent in solid, liquid, or gas form. Similarly, the extinguishing agent reservoir is configured to hold the at least one extinguishing agent in a pressurized or non-pressurized state depending on the particular extinguishing agent used. The automatic fire suppression system may further comprise a propellant if the extinguishing agent is stored in a non-pressurized state. The propellant is operatively connected to the extinguishing agent reservoir and will pressurize the extinguishing agent reservoir when triggered.

The automatic fire suppression system further comprises a distribution component. The distribution component comprises a plurality of orifices and is configured to dispense the at least one extinguishing agent. Once the at least one extinguishing agent is released from the extinguishing agent reservoir, the at least one extinguishing agent is expelled from the plurality of orifices onto the fire.

The automatic fire suppression system further comprises a detection component. The detection component is configured to trigger the release of the at least one extinguishing agent from the extinguishing agent reservoir. The extinguishing agent reservoir comprises a mechanism for releasing the at least one extinguishing agent once triggered by the detection component. The detection component may comprise a heat detector, a smoke detector, or both. The smoke detector may comprise an ionizing smoke detector, a photoelectric smoke detector, or a combination thereof.

The automatic fire suppression system further comprises a mounting component. The mounting component is configured to attach the automatic fire suppression system a surface, such as a ceiling in a house, or a vehicle. If used for a vehicle, the automatic fire suppression system in mountable under a hood of the vehicle or above the vehicle's engine if located elsewhere by the mounting component. The mounting component may comprise a mechanical bracket for attaching the housing of the automatic fire suppression system to the ceiling of the house or to the vehicle.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION OF THE INVENTION

Figure 1:
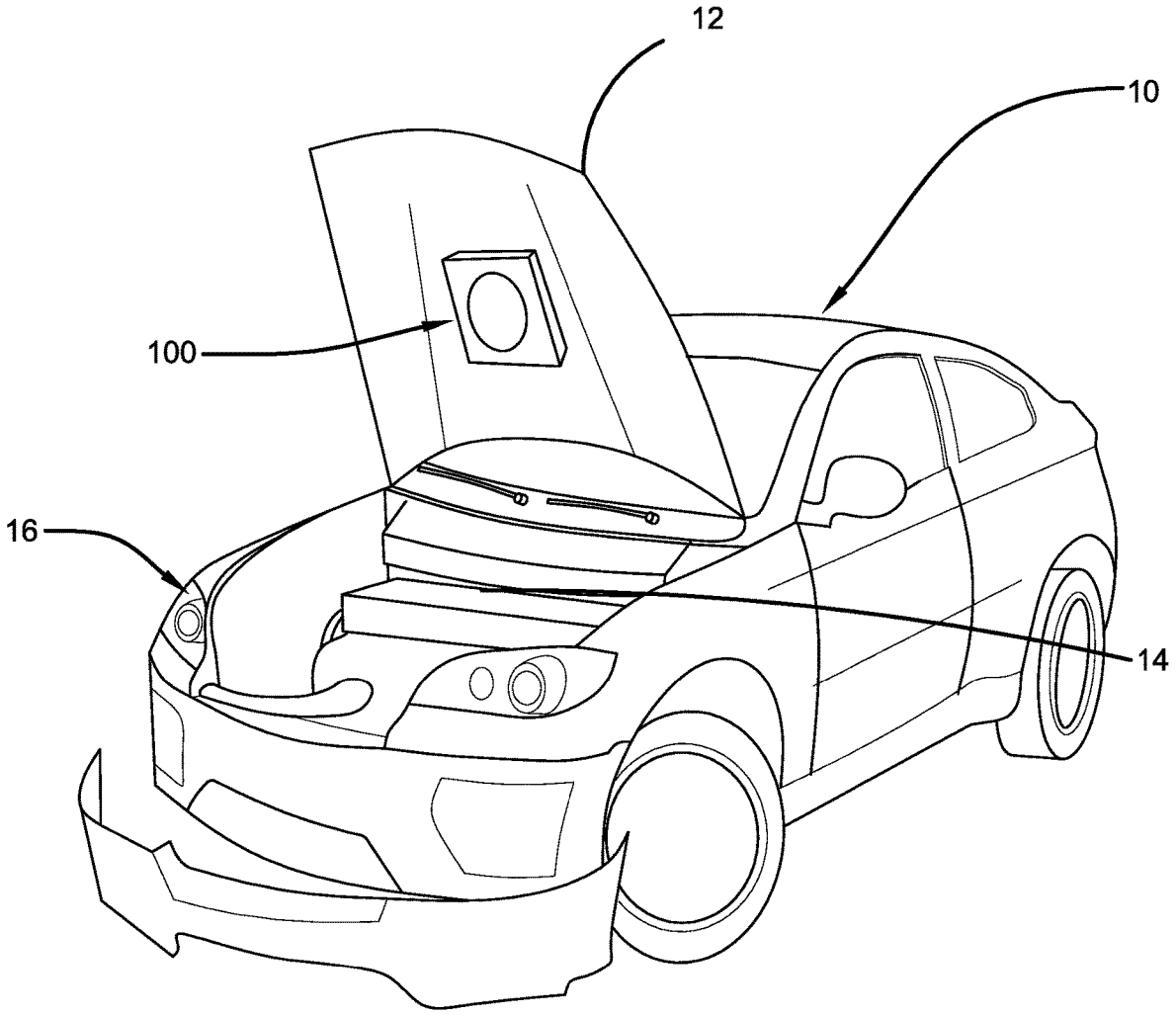
FIG. 1 illustrates a perspective view of an automatic fire suppression system for suppressing a vehicle fire installed on an underside of a hood of the vehicle in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a unique fire extinguishing system capable of immediately detecting and extinguishing a residential fire or an engine fire in a vehicle before the fire consumes the residence or the vehicle and injures the occupants. The fire extinguishing system typically installs on a ceiling or a wall in a house or underneath the vehicle hood and mounts via a secure fastener system, such as, but not limited to a mounting bracket assembly, a secure fastener system, or a kit. The fire extinguishing system includes smoke and heat sensors configured to detect raised temperatures and excessive levels of smoke, triggering the system to dispense the extinguishing chemicals. The extinguishing agent may be a single or a combined chemical formula utilized for completely eradicating a fire quickly and effectively before more damage occurs to the house or the vehicle and puts passengers in further danger.

The fire extinguishing system is a mountable device used to dispense fire extinguishing material in the event of a house fire or an engine fire. The device may be rectangular, square, circular, or any geometric shape with an interior volume used to store combined chemicals capable of immediately putting out a fire. The device may be equipped with a heat sensor and a smoke sensor configured to detect raised temperatures and excessive levels of smoke. Once a sensor is triggered, the device can open to dispense the combined chemicals. The combined chemicals are intended to dampen the fire and prevent it from spreading to other parts of the house or the vehicle. The extinguishing system could be installed in a home, office, or other indoor area for fire prevention tactics. The exact size, measurement, construction, and design specifications may vary depending on application and manufacturing requirements.

Figure 8:
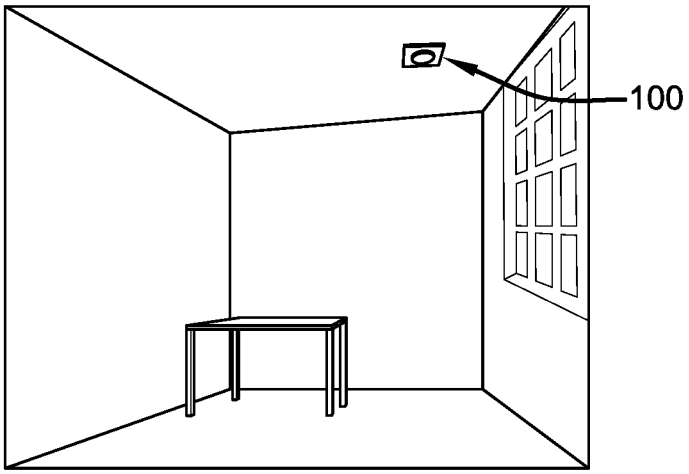
FIG. 8 illustrates a perspective view of the automatic fire suppression system installed in a house in accordance with the disclosed architecture.

Referring initially to FIG. 1, an automatic fire suppression system 100 is attached to a vehicle 10. The automatic fire suppression system 100 is mounted to an underside of a hood 12 of the vehicle 10. The automatic fire suppression system 100 is mounted so as to protect an engine 14 located in an engine compartment 16 of the vehicle 10 in the event of a fire. The automatic fire suppression system 100 is also mountable above the vehicle's engine if located elsewhere. Alternatively, as illustrated in FIG. 8, the automatic fire suppression system 100 may be mounted to ceiling or wall of a residential or commercial indoor location as desired.

Figure 4:
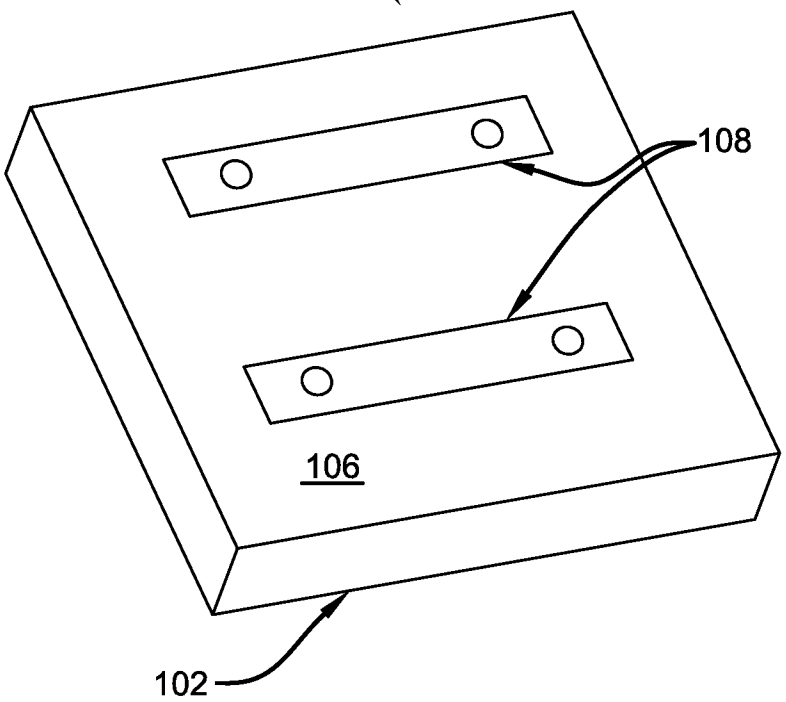
FIG. 4 illustrates a perspective view of a mounting component of the automatic fire suppression system the in accordance with the disclosed architecture.

As illustrated in FIGS. 2-7, the automatic fire suppression system 100 comprises housing 102. The housing 102 may be constructed from high grade plastic, aluminum, iron, metal alloy, or any other material that can withstand high heat. The housing 102 comprises a front side 104 and a back side 106. The front side 104 is positioned so as to face the engine 14, and the back side 106 is positioned against the underside of the hood 12 of the vehicle 10 when mounted. As illustrated in FIG. 4, the automatic fire suppression system 100 further comprises a mounting component 108. The mounting component 108 is positioned on the back side 106 of the housing 102 for attaching the automatic fire suppression system 100 to the vehicle 10. The mounting component 108 may be a mechanical bracket, a fastener, an adhesive, a magnetic attachment, a kit assembly, or the like. Alternatively, the back side 106 is positioned against the ceiling of a room with the front side 104 facing downward. The mounting component 108 then attaches the housing 102 to the ceiling.

Figure 3:
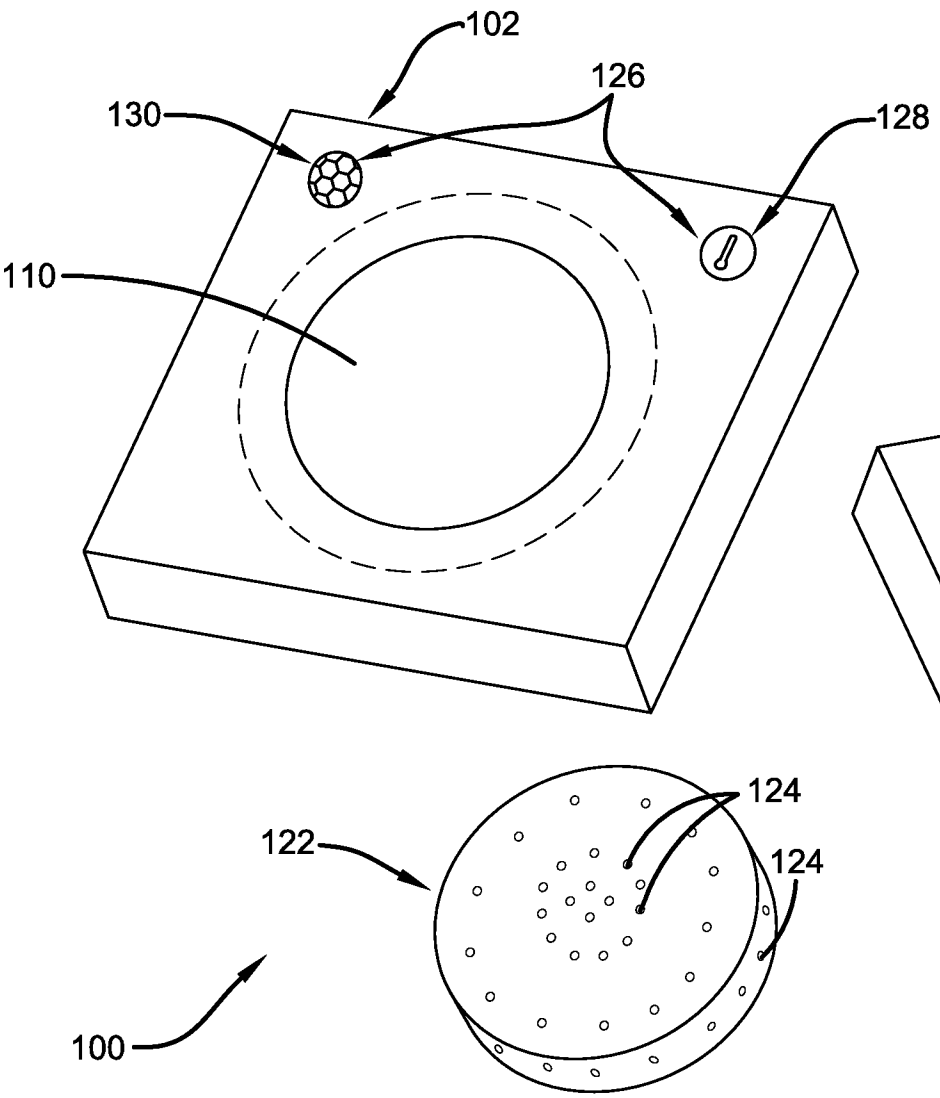
FIG. 3 illustrates an exploded view of the automatic fire suppression system in accordance with the disclosed architecture.
Figure 5:
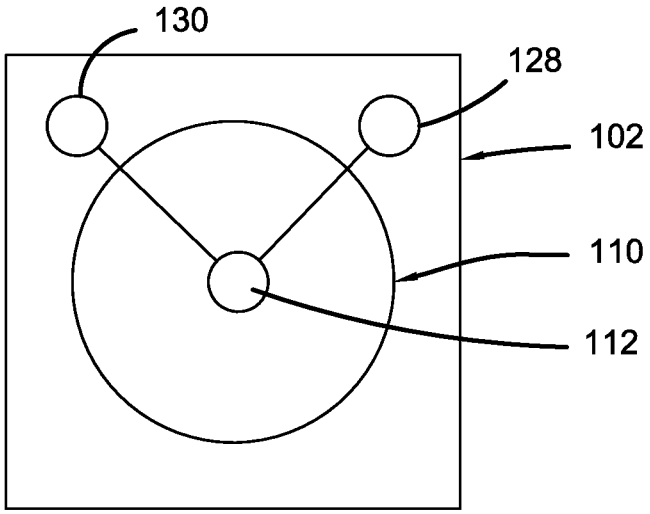
FIG. 5 illustrates an overhead view of an extinguishing agent reservoir and a detection component of the automatic fire suppression system in accordance with the disclosed architecture.

As illustrated in FIG. 3, the automatic fire suppression system 100 further comprises an extinguishing agent reservoir 110. The extinguishing agent reservoir 110 may be a bladder or a plastic container constructed to hold solids, liquids, or gasses under pressure and is located within the housing 102 and configured to retain at least one extinguishing agent. As illustrated in FIG. 5, the extinguishing agent reservoir 110 comprises a discharge mechanism 112. The discharge opening 112 may be a rupture disc 114 as illustrated in FIG. 6, a valve, a closable opening, or the like.

The at least one extinguishing agent may be a mixture of different extinguishing agents or may be a single extinguishing agent. The at least one extinguishing agent may be retained in a solid, liquid, or gas state, and may be pressurized or unpressurized. The at least one extinguishing agent will be effective to suppress Class A, Class B and Class C fires. Class A fires are fires involving ordinary solid combustibles, Class B fires are fires involving both flammable liquids and gasses, and Class C fires are fires involving energized electrical equipment. Examples of acceptable extinguishing agents may include a compressed gas, such as carbon dioxide, argon, nitrogen, or combinations thereof; a solution with a surfactant, such as aqueous film forming foams, alcohol-resistant aqueous film forming foams, protein foams, or combinations thereof; a dry chemical, such as monoammonium phosphate, sodium bicarbonate, ammonium sulfate, or combinations thereof.

Figure 6:
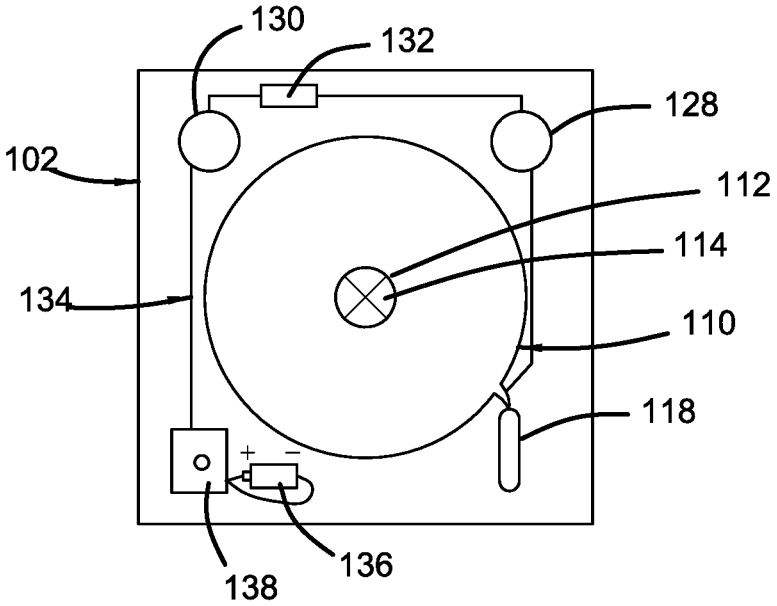
FIG. 6 illustrates an overhead view of the extinguishing agent reservoir and the detection component of the automatic fire suppression system in accordance with the disclosed architecture.

As illustrated in FIG. 6, the automatic fire suppression system 100 may further comprise a propellant 118 if the extinguishing agent is stored in a non-pressurized state. The propellant 118 is operatively connected to the extinguishing agent reservoir 110 and will pressurize the extinguishing agent reservoir 110 when triggered. Typically, the propellant 118 is a small compressed gas cylinder with enough pressure to pressurize the extinguishing agent reservoir 110 enough to expel the at least one extinguishing agent.

Figure 2:
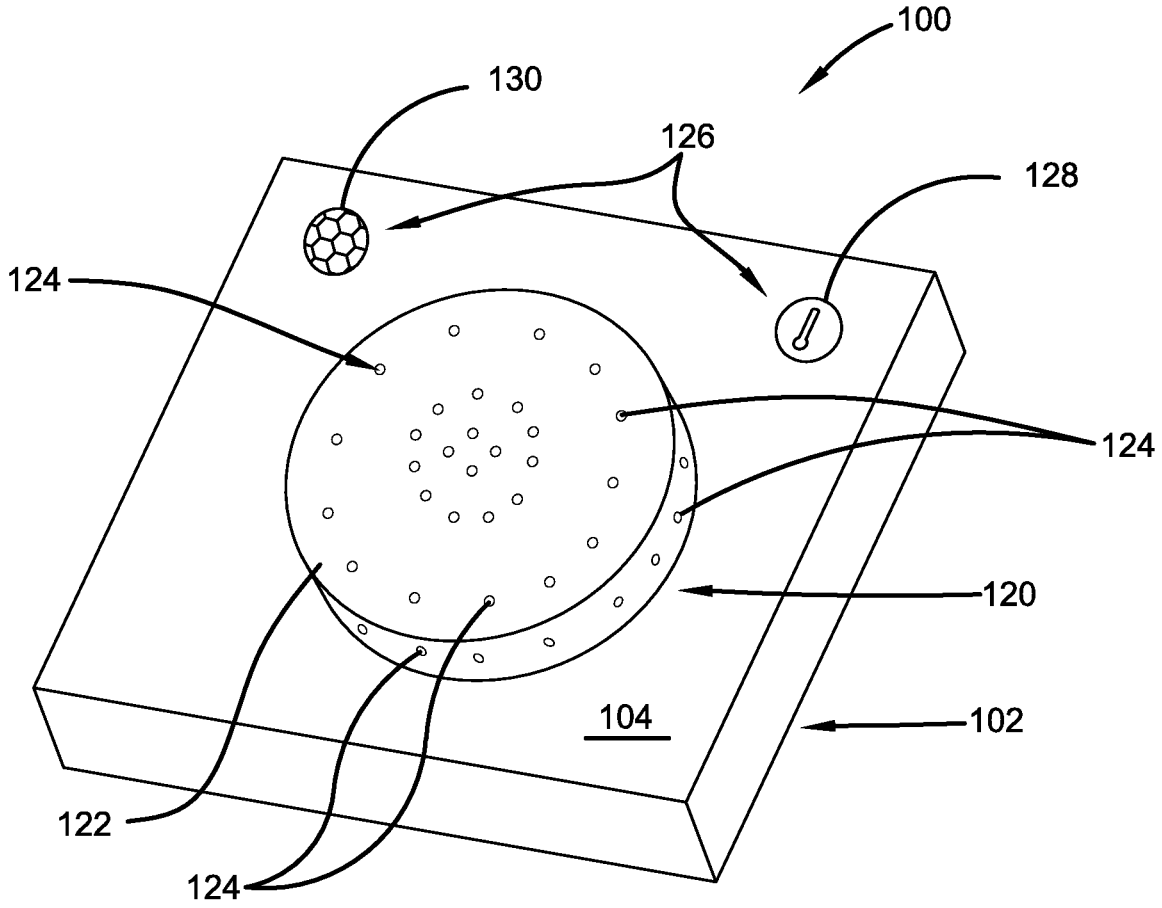
FIG. 2 illustrates a perspective view of the automatic fire suppression system in accordance with the disclosed architecture.

As illustrated in FIGS. 2 and 3, the automatic fire suppression system 100 further comprises a distribution component 120. The distribution component 120 comprises a distribution housing 122 attachable to the front side 104 of the housing 102 of the automatic fire suppression system 100. The distribution component 120 comprises a plurality of orifices 124. The plurality of orifices 124 may be openings, holes, outlets, or individual nozzles located throughout the distribution housing 122 configured to provide suppression coverage throughout the room of the house or the engine compartment 16 of the vehicle 10. The distribution component 120 dispenses the at least one extinguishing agent when released from the extinguishing agent reservoir 110.

As illustrated in FIGS. 5 and 6, the automatic fire suppression system 100 further comprises a detection component 126. The detection component 126 is configured to detect heat, smoke, or both and trigger the release of the at least one extinguishing agent. The detection component 126 comprises a heat detector 128. The heat detector 128 may be a fixed temperature heat sensor or detector or a rate-of-rise heat sensor or detector. The heat detector 128 is configured to trigger the release of the at least one extinguishing agent when it detects a temperature of about 140 degrees Fahrenheit or higher in a structure, and to trigger the release of the at least one extinguishing agent when it detects a temperature of about 225 degrees Fahrenheit or higher in a vehicle.

Figure 7:
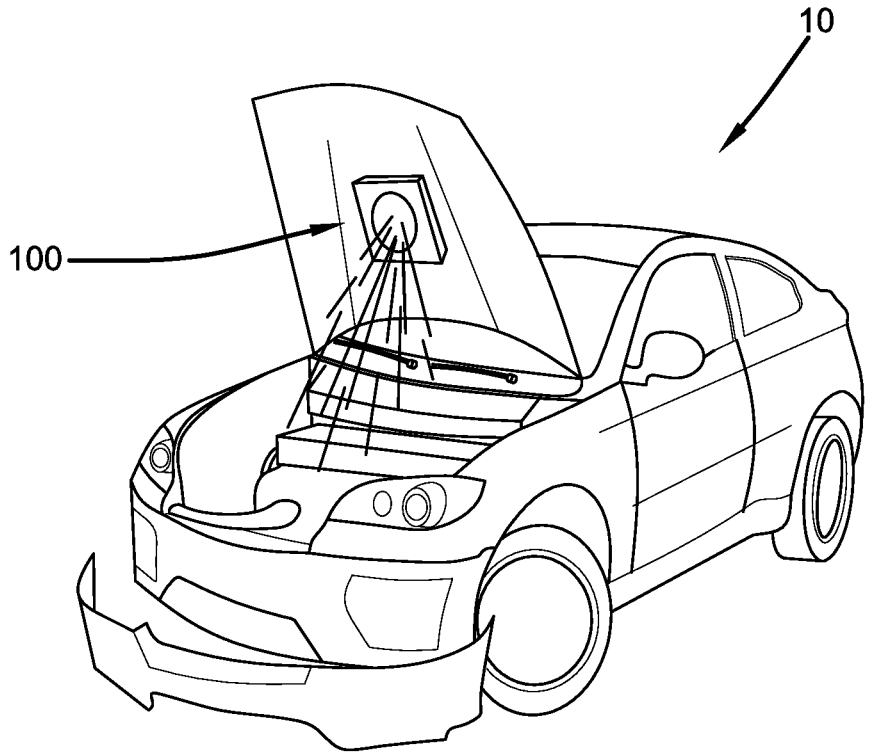
FIG. 7 illustrates a perspective view of the automatic fire suppression system installed on the underside of the hood of the vehicle actively discharging an extinguishing agent in accordance with the disclosed architecture.

The detection component 126 may further comprise a smoke detector 130. The smoke detector 130 may be an ionization smoke sensor or detector, a photoelectric smoke sensor or detector, or a combination thereof. The smoke detector 130 is configured to trigger the release of the at least one extinguishing agent when it detects smoke. As such, the at least one extinguishing agent is released from the extinguishing agent reservoir 110 into the distribution component 120 when the detection component detects an extreme rise in temperature, a high level of smoke, or a fire and triggers the release. The distribution component 120 then expels the at least one extinguishing agent onto the fire or higher as illustrated in FIG. 7.

The detection component 126 may further comprise a control element 132, a power source 136, and a circuit 134. The control element 132 may be a central processing unit, and the power source 136 may be a battery, or a plug for connecting to a residential electrical system. The circuit 134 connects the control element 132, the battery 126, the heat detector 128, the smoke detector 130, and the propellent 118 if used. Alternatively, the heat detector 128 and the smoke detector 130 may be directly linked to the extinguishing agent reservoir 110 to control the release of the at least one extinguishing agent. The automatic fire suppression system 100 may further comprise an alarm 138 connected to the circuit 134 for alerting occupants of the activation of the automatic fire suppression system 100.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An automatic fire suppression system comprising:

an extinguishing agent reservoir comprising a bladder for retaining at least one extinguishing agent and a closable opening for releasing the at least one extinguishing agent;

a distribution component comprising a plurality of orifices, wherein each of the plurality of orifices comprises an individual nozzle for dispensing the at least one extinguishing agent; and a detection component for detecting heat or smoke, the detection component comprising a heat sensor configured to trigger the release of the at least one extinguishing agent at a temperature of 140 degrees Fahrenheit and a combination ionizing photoelectric smoke detector configured to trigger the release of the at least one extinguishing agent upon detecting smoke; and a mounting component for magnetically or adhesively attaching the automatic fire suppression system to a surface; and wherein the detection component further comprises a control element electrically connectable to a battery and a residential electrical power source; and wherein the at least one extinguishing agent is a compressed gas and is effective to suppress flammable liquid fires and fires involving energized electrical equipment; and wherein the automatic fire suppression system is mountable within an engine compartment of a vehicle and to a ceiling within a building.

2. An automatic vehicle engine compartment fire suppression system comprising:

an extinguishing agent reservoir comprising a closable opening for retaining at least one extinguishing agent;

a non-solid compressed gas propellant operatively connected to the extinguishing agent reservoir;

a distribution component comprising a plurality of orifices, wherein each of the plurality of orifices comprises an individual nozzles for dispensing the at least one extinguishing agent comprising a plurality of orifices; and a detection component comprising a rate-of rise heat sensor for triggering the release of the at least one extinguishing agent upon an extreme rise in temperature, a fixed temperature heat sensor for triggering the release of the at least one extinguishing agent at 225 degrees Fahrenheit, and a combination ionizing photoelectric smoke detector for triggering the release of the at least one extinguishing agent upon detecting smoke;

a magnetic mounting component for attaching the automatic vehicle engine compartment fire suppression system to an underside of a hood of a vehicle; and an alarm for alerting the vehicle's occupants; and wherein the least one extinguishing agent is effective to suppress Class A fires, flammable liquid fires and fires involving energized electrical equipment; and wherein the detection component further comprises a control element in electrical communication with a power source for releasing the propellant and activating the alarm.

3. The automatic fire suppression system of claim 2, wherein the extinguishing agent reservoir comprises a rupture disc.

* * * * *